US011224285B2

(12) United States Patent
Outa et al.

(10) Patent No.: US 11,224,285 B2
(45) **Date of Patent: *Jan. 18, 2022**

(54) UNDERWATER MARINE GROWTH BRUSHING MECHANISM WITH PASSIVE SELF-ADJUST FOR CURVED SURFACES

(71) Applicant: Saudi Arabian Oil Company, Dhahran (SA)

(72) Inventors: Ali Outa, Thuwal (SA); Fadl Abdellatif, Thuwal (SA); Ayman Amer, Thuwal (SA); Sahejad Patel, Thuwal (SA); Hassane Trigui, Thuwal (SA); Ameen Obedan, Thuwal (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 16/437,358

(22) Filed: Jun. 11, 2019

(65) Prior Publication Data

US 2019/0289993 A1 Sep. 26, 2019

Related U.S. Application Data

(63) Continuation of application No. 15/174,552, filed on Jun. 6, 2016, now Pat. No. 10,342,326.

(51) Int. Cl.
*A46B 13/00* (2006.01)
*A46B 13/02* (2006.01)
(Continued)

(52) U.S. Cl.
CPC ..... *A46B 13/02* (2013.01); *A46B 13/008* (2013.01); *B08B 1/04* (2013.01); *B08B 9/023* (2013.01);
(Continued)

(58) Field of Classification Search
CPC ..... A46B 13/02; A46B 13/008; B08B 1/04; B08B 9/023; B08B 1/002; B63B 59/08; B63B 59/06; E02B 17/0034
(Continued)

(56) References Cited

U.S. PATENT DOCUMENTS 3,430,279 A 3/1969 Hintze
4,102,290 A 7/1978 Weiss
(Continued)

FOREIGN PATENT DOCUMENTS

CN 203737674 U 7/2014
CN 204380980 U 6/2015
(Continued)

OTHER PUBLICATIONS

LateraLas, "FlexiClean marine fouling remover," Ultra-fast and effective tool for clearing marine growth. Deepwater. Retrieved 2016.

(Continued)

*Primary Examiner* — Joseph J Hail
*Assistant Examiner* — J Stephen Taylor
(74) *Attorney, Agent, or Firm* — Leason Ellis LLP

(57) ABSTRACT

A cleaning device that passively self-adjusts to improve biofoul removal across curved, non-uniform, or irregular underwater surfaces. The cleaning device includes a motor, one or more shafts coupled to the motor and coupled to one another via at least one universal joint, and a cleaning mechanism for removing biofoul from the target surface. The cleaning device includes an alignment mechanism that restricts the cleaning mechanism's movement to improve biofoul removal. The alignment mechanism can include bearings, spring components, dampening material, adhesion components, floatation objects, or a combination thereof.

18 Claims, 7 Drawing Sheets

(51) Int. Cl.

| | |
|---|---|
| ***B08B 1/04*** | (2006.01) |
| ***B63B 59/08*** | (2006.01) |
| ***B08B 9/023*** | (2006.01) |
| ***B63B 59/06*** | (2006.01) |
| *E02B 17/00* | (2006.01) |

(52) U.S. Cl.
CPC ..... *B63B 59/06* (2013.01); *B63B 59/08* (2013.01); *E02B 17/0034* (2013.01)

(58) Field of Classification Search
USPC ..... 15/21.1, 23, 28, 29, 52, 98
See application file for complete search history.

(56) References Cited

U.S. PATENT DOCUMENTS

| | | | | |
|---|---|---|---|---|
| 4,279,212 | A | 7/1981 | Lundberg | |
| 5,282,289 | A | 2/1994 | Hasegawa et al. | |
| 5,533,581 | A | 7/1996 | Barth et al. | |
| 5,809,601 | A * | 9/1998 | Rivera | A46B 13/02 15/104.05 |
| 5,964,003 | A | 10/1999 | Rogers | |
| 6,877,452 | B1 | 4/2005 | Hudd | |
| 7,356,867 | B1 * | 4/2008 | Beiermann | A46B 13/001 15/104.04 |
| 7,699,066 | B2 | 4/2010 | Andersen et al. | |
| 9,844,259 | B2 | 12/2017 | Pender | |
| 2004/0083567 | A1 * | 5/2004 | Lies | A47L 11/162 15/28 |
| 2005/0071944 | A1 | 4/2005 | Sherf et al. | |
| 2012/0317750 | A1 | 12/2012 | Ostervold et al. | |

FOREIGN PATENT DOCUMENTS

| | | |
|---|---|---|
| EP | 0 275 605 | 7/1988 |
| EP | 0 744 139 | 11/1996 |
| FR | 1 558 592 | 2/1969 |
| JP | H1085808 A | 4/1998 |
| JP | H1086050 A | 4/1998 |

OTHER PUBLICATIONS

International Search Report and Written Opinion of the International Searching Authority in Corresponding PCT Application No. PCT/US2017/035739 dated Sep. 27, 2017. 14 pages.

Examination Report in Corresponding Gulf Coast Application No. 2017-33511 dated Apr. 17, 2019. 5 pages.

Examination Report in Corresponding Gulf Coast Application No. 2017-33511 dated Aug. 23, 2019. 3 pages.

Examination Report in Corresponding Singapore Application 11201810012Q dated Feb. 17, 2020. 6 pages.

Office Action in corresponding Chinese Application No. 201780030027.7 dated Jan. 22, 2021. 32 pages.

Japanese Office Action in Corresponding JP Application No. 2019-515784 dated Apr. 5, 2021. 6 pages.

Office Action (and English translation) in corresponding Korean Application No. 10-2018-7029887; OA dated Sep. 27, 2021 (and translation provided Oct. 6, 2021), 6 pages.

Office Action (and English translation) in corresponding Chinese Application No. 201780030027.7; OA dated Aug. 3, 2021 (and translation provided Aug. 27, 2021), 12 pages.

* cited by examiner

UNDERWATER MARINE GROWTH BRUSHING MECHANISM WITH PASSIVE SELF-ADJUST FOR CURVED SURFACES

CROSS-REFERENCE TO RELATED APPLICATIONS

This patent application is a continuation application of U.S. application Ser. No. 15/174,552, filed Jun. 6, 2016, entitled "Underwater Marine Growth Brushing Mechanism With Passive Self-Adjust for Curved Surfaces," now U.S. Pat. No. 10,342,326, which is hereby incorporated by reference as if expressly set forth in its entirety herein.

FIELD OF THE APPLICATION

This patent application generally relates to motorized cleaning mechanisms, and more particularly to devices for cleaning underwater marine device fouling using a remotely operated vehicle.

BACKGROUND OF THE APPLICATION

It is a common practice for underwater surfaces, such as boat hulls, pilings, pipelines, and risers to be cleaned with some frequency in order to curb undesired marine growth (or "biofouling") on such surfaces. For example, barnacles or other large biological organisms adhere to such surfaces and can damage or impair the surface if left untreated. Further, biofoul becomes more difficult to remove the longer it remains unchecked on the surface. In a typical scenario, biofoul can be removed by brushes, hammers, water jets, sandblasting, or other cleaning mechanisms that are coupled to a remotely operated vehicle ("ROV"). However, as the cleaning mechanism contacts a curved, non-uniform, or irregular surface, the traction and gravitational forces imparted upon the ROV effect the ROV's stability and motion, which decreases cleaning efficiency and increases the time necessary to remove biofoul.

It is in regard to these issues that the present invention is provided.

BRIEF DESCRIPTION OF THE DRAWINGS

The accompanying drawing figures illustrate an exemplary embodiment and are not intended to be limiting of the invention. Among the drawing figures, like references are intended to refer to like or corresponding parts.

SUMMARY OF THE INVENTION

Figure 1:
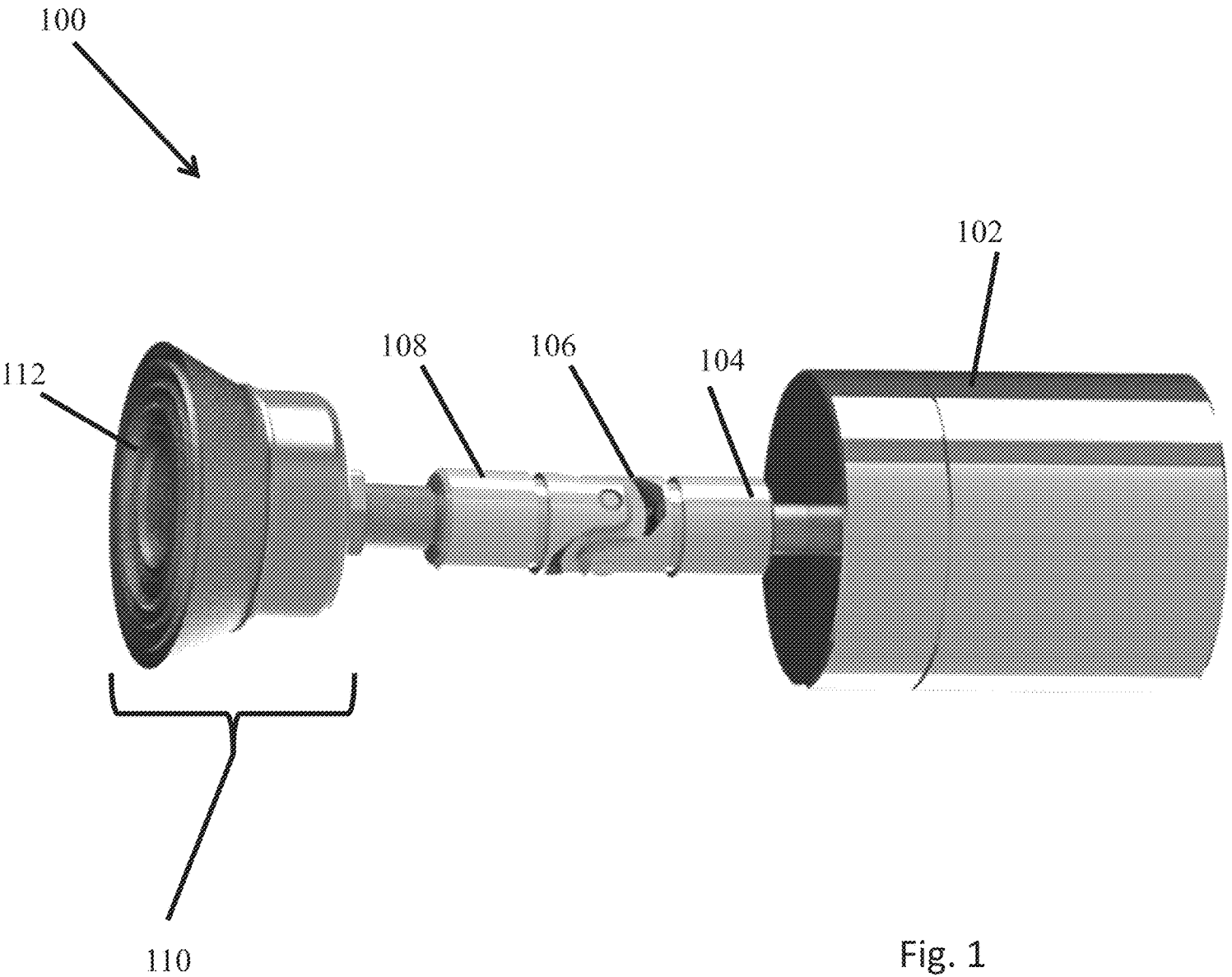
FIG. 1 illustrates an example cleaning device in accordance with at least one implementation of the present application.

Embodiments of the invention are directed towards a device for cleaning an underwater surface of an object, and more specifically a cleaning device which can be attached to a remotely operated vehicle ("ROV") that passively aligns to clean curved surfaces.

In accordance with one aspect of the invention, a device for cleaning an underwater surface of an object is provided. The device includes a motor housing and a motor for providing power disposed within the motor housing. The device according to this embodiment includes a first shaft having a proximal end coupled to the motor and a distal end, such that the first shaft extends longitudinally from the motor along a first axis, and in which the motor provides power to the first shaft to enable the first shaft to rotate around the first axis. Further, the device includes a universal joint having a first end and a second end, in which the first end is coupled to the distal end of the first shaft, and the second end is coupled to a proximal end of a second shaft. The second shaft extends longitudinally away from the universal joint along a second axis, such that the universal joint transfers the power of the motor to the second shaft to enable the second shaft to rotate around the second axis, and in which the second shaft has one or more degrees of freedom of movement.

Continuing with this aspect of the invention, the device includes a cleaning mechanism coupled to a distal end of the second shaft and includes a cleaning face disposed in a plane substantially perpendicular to the second axis. The device further includes an alignment mechanism disposed about the second shaft. The alignment mechanism can be shaped and sized to restrict movement of the second shaft to within a prescribed maximum angle relative to the first shaft, such that the cleaning mechanism is oriented by the alignment mechanism substantially transverse to the surface of the object throughout any cleaning of the underwater surface.

In accordance with another aspect of the invention as may be implemented in various embodiments, a device for cleaning an underwater surface of an object is provided. The device includes a motor housing and a motor for providing power disposed within the motor housing. The device according to this embodiment includes a first shaft having a proximal end coupled to the motor and a distal end, such that the first shaft extends longitudinally from the motor along a first axis, and in which the motor provides power to the first shaft to enable the first shaft to rotate around the first axis. Further, the device includes a universal joint having a first end and a second end, in which the first end is coupled to the distal end of the first shaft and the second end is coupled to proximal end of a second shaft. The second shaft extends longitudinally away from the universal joint along a second axis, in which the universal joint transfers the power of the motor to the second shaft to enable the second shaft to rotate around the second axis, and in which the second shaft has one or more degrees of freedom of movement.

Continuing with this aspect of the invention, the device includes a cleaning mechanism coupled to a distal end of the second shaft, the cleaning mechanism having a cleaning face disposed in a plane substantially perpendicular to the second axis and having a planetary gear set. The planetary gear set includes a sun gear, a plurality of planetary gears meshed with the sun gear, a ring gear meshed with the planetary gears, and a carrier coupled to the planetary gears, a first brush, and a second brush. The device additionally includes an alignment mechanism disposed about the second shaft, the alignment mechanism shaped and sized to restrict movement of the second shaft to within a prescribed maximum angle relative to the first shaft, such that the cleaning mechanism is oriented by the alignment mechanism substantially transverse to the surface of the object throughout any cleaning of the underwater surface.

In accordance with another aspect of the invention as may be implemented in various embodiments, a device for cleaning an underwater surface of an object is provided. The device includes a motor housing and a motor for providing power disposed within the motor housing. A first shaft is included, having a proximal end coupled to the motor and a distal end, such that the first shaft extends longitudinally from the motor along a first axis, and in which the motor provides power to the first shaft to enable the first shaft to rotate around the first axis. The device further includes a first universal joint having a first end and a second end, in which the first end is coupled to the distal end of the first shaft, a linking component, and a second universal joint. The linking component has a proximal end coupled to the second end of the first universal joint and a distal end, such that the linking component extends longitudinally away from the first universal joint along a second axis, in which the first universal joint transfers the power of the motor to the linking component to enable the linking component to rotate around the second axis, and in which the linking component has one or more degrees of freedom of movement. The second universal joint has a first end and a second end, in which the first end is coupled to the distal end of the linking component. Additionally, the device includes a second shaft having a proximal end coupled to the second end of the second universal joint and a distal end, such that the second shaft extends longitudinally away from the second universal joint along a third axis, in which the second universal joint transfers the power of the motor to the second shaft to enable the second shaft to rotate around the third axis, and in which the second shaft has one or more degrees of freedom of movement.

Continuing with this aspect of the invention, the device includes a cleaning mechanism coupled to the distal end of the second shaft, such cleaning mechanism having a cleaning face disposed in a plane substantially perpendicular to the second axis.

DETAILED DESCRIPTION OF CERTAIN EMBODIMENTS OF THE INVENTION

The invention is now described with reference to the accompanying drawings, which form a part hereof, and which show, by way of illustration, example implementations and/or embodiments of the present invention. It is to be understood that other embodiments can be implemented and structural changes can be made without departing from the spirit of the present invention. Among other things, for example, the disclosed subject matter can be embodied as methods, devices, components, or systems.

Furthermore, it is recognized that terms may have nuanced meanings that are suggested or implied in context beyond an explicitly stated meaning. Likewise, the phrase "in one implementation" as used herein does not necessarily refer to the same implementation and the phrase "in another implementation" as used herein does not necessarily refer to a different implementation. It is intended, for example, that claimed subject matter can be based upon combinations of individual example implementations, or combinations of parts of individual example implementations.

In accordance with the present application, motorized cleaning devices coupled to an ROV provide the advantages of, for example, biofoul removal from locations that above-water-based cleaning systems cannot reach and improved specific-surface-attack accuracy thereby providing greater biofoul removal efficiency. Currently available motorized cleaning devices include sophisticated robotic arms and/or grippers which require work-class ROVs to withstand the large vibrations present in the cleaning process. Smaller ROVs, which rely on motorized cleaning devices, lock the devices at a specified orientation and rely on complex control algorithms to direct the cleaning device into an underwater surface to be cleaned (a "target surface"). However, ROV cleaning devices of this latter type have difficulty maintaining optimal cleaning device orientation toward the target surface when the target surface is curved, non-uniform, or irregular because, upon surface contact, a traction force is imparted to the cleaning device. This traction force temporarily destabilizes the ROV and disorients the cleaning device thereby increasing the time necessary to clean the target surface. Additionally, gravitational effects further disorient the cleaning device by pulling it downward.

In accordance with one or more implementations, passive, self-adjusting cleaning devices for ROVs are described. More specifically, a powered cleaning device for ROVs is disclosed, which passively aligns a cleaning mechanism to a curved, non-uniform, or irregular underwater surface to provide enhanced cleaning performance and minimize destabilizing effects on the ROV. The cleaning device disclosed herein provides the advantage of being able to adapt to the contour of curved surfaces, such as, for example, pipelines, risers, or boat hulls. In one aspect, the cleaning device has one or more degrees of freedom of movement for aligning the cleaning mechanism substantially transverse to a target surface. In a further aspect, the cleaning mechanism contacts the target surface at two diametrically opposed points to minimize traction effects. In an additional aspect, the cleaning device includes an alignment mechanism to minimize traction and gravitational forces. More specifically, an alignment mechanism restricts the cleaning mechanism's motion to a specified range in order to minimize such traction and gravitational forces and maximize ROV stability. In one aspect, a cleaning mechanism is provided having cleaning instruments such as brushes, bristles, or water jets. In a further aspect, the cleaning mechanism includes a plurality of concentric brushes that are capable of spinning in alternate directions using a planetary gears system.

Referring to FIG. 1, an example cleaning device 100 in accordance with one or more implementations of the present application is provided. A motor 102 disposed in a housing is attached to a proximal end of a rotatable first shaft 104 that extends longitudinally along a first axis. The motor provides power to rotate the first shaft around the first axis. The distal end of the first shaft 104 is coupled to a universal joint 106. The universal joint 106 can be any conventional universal joint known in the art (e.g., a Cardan or Hooke type) that can transfer rotational power (e.g., speed and torque) between two shafts while providing at least two degrees of freedom of movement (e.g., rotational motion and angular motion). In the example cleaning device 100, the universal joint 106 is also coupled to a proximal end of a rotatable second shaft 108 that extends longitudinally from the universal joint along a second axis. The universal joint 106 enables the second shaft 108 to receive rotational motion of the first shaft 104 such that the second shaft can rotate about the second axis and also so that the second shaft can angularly displace (i.e., pitch) about a rotational axis having a center point at the universal joint. As the second shaft 108 pitches about the rotational axis, an angle is created between the first shaft 104 and the second shaft 108. This angle can be restricted by the type of universal joint 106 chosen.

A cleaning mechanism 110 having a cleaning face 112 is coupled to a distal end of the second shaft 108. The cleaning mechanism 110 receives the rotational motion of the second shaft 108 about the second axis, which in turn enables a cleaning face 112 to rotate in a plane substantially perpendicular to the second axis. The cleaning face 112 can, for example, include cleaning instruments such as brushes, bristles, or water jets. As the cleaning face 112 rotates, the cleaning instruments contact the target surface and remove biofoul. In one or more implementations, the motor 102 can provide power to change the rotation direction of the cleaning device 100 components (e.g., from clockwise to counter-clockwise and vice versa). Alternating rotational direction allows, for example, a cleaning face 112 having brushes to alternatively scrub the target surface in both rotational directions, thereby enhancing efficiency of the cleaning. This motion can be achieved mechanically (e.g., via a crank shaft) or controlled electrically.

To enhance the effectiveness of biofoul removal from a curved underwater surface, the angle of attack (the direction and path of the cleaning mechanism 110 toward the target surface) is directed at the center of curvature of the target surface. An angle of attack directed elsewhere limits the effectiveness of the universal joint 106 in orienting the cleaning mechanism 110. This includes maintaining an alignment of the cleaning mechanism 110 substantially transverse to the target surface. The angle of attack can be determined from, for example, the distance from the universal joint 106 to the cleaning face 112 and the curvature of the target surface, and also should account for a specified range of deviation, in order to maintain the angle of attack as the cleaning mechanism 110 moves towards the target surface (e.g., if the ROV is driven forward or if the cleaning face 112 contacts the target surface). The universal joint 106, in accordance with an aspect of the invention, locks the angle of attack within the specified range of deviation, still allowing for minor deviations caused by ROV movement or surface contact while maintaining an efficient cleaning orientation.

In one or more implementations, an adhesion component is introduced to the cleaning device 100 to enhance its passive self-orienting capabilities. For example, the cleaning mechanism 110 or cleaning face 112 can be magnetized (e.g., via a rare earth magnet like neodymium or an electromagnet) to assist in guiding the transverse orientation of the cleaning face to ferromagnetic curved surfaces such as pipes. In one or more implementations, the adhesion component includes suction mechanisms for guiding the cleaning face toward non-ferromagnetic target surfaces.

However, if the only alignment mechanism of the cleaning device 100 were the universal joint 106, then the cleaning device would be particularly vulnerable to traction and gravitational forces. Such forces can disorient the cleaning mechanism 110 and disrupt the angle of attack. In particular, if the orientation of the cleaning mechanism 110 were such that only one point of the cleaning face 112 contacts the target surface, the cleaning mechanism 110 would behave like a rotating wheel. This would create a traction force which drags or pushes the cleaning device 100 linearly along the surface. Additionally, gravitational forces can disorient the cleaning mechanism 110 by acting to continuously pulling the cleaning mechanism and cleaning face 112 to point in a downward direction.

Figure 2A:
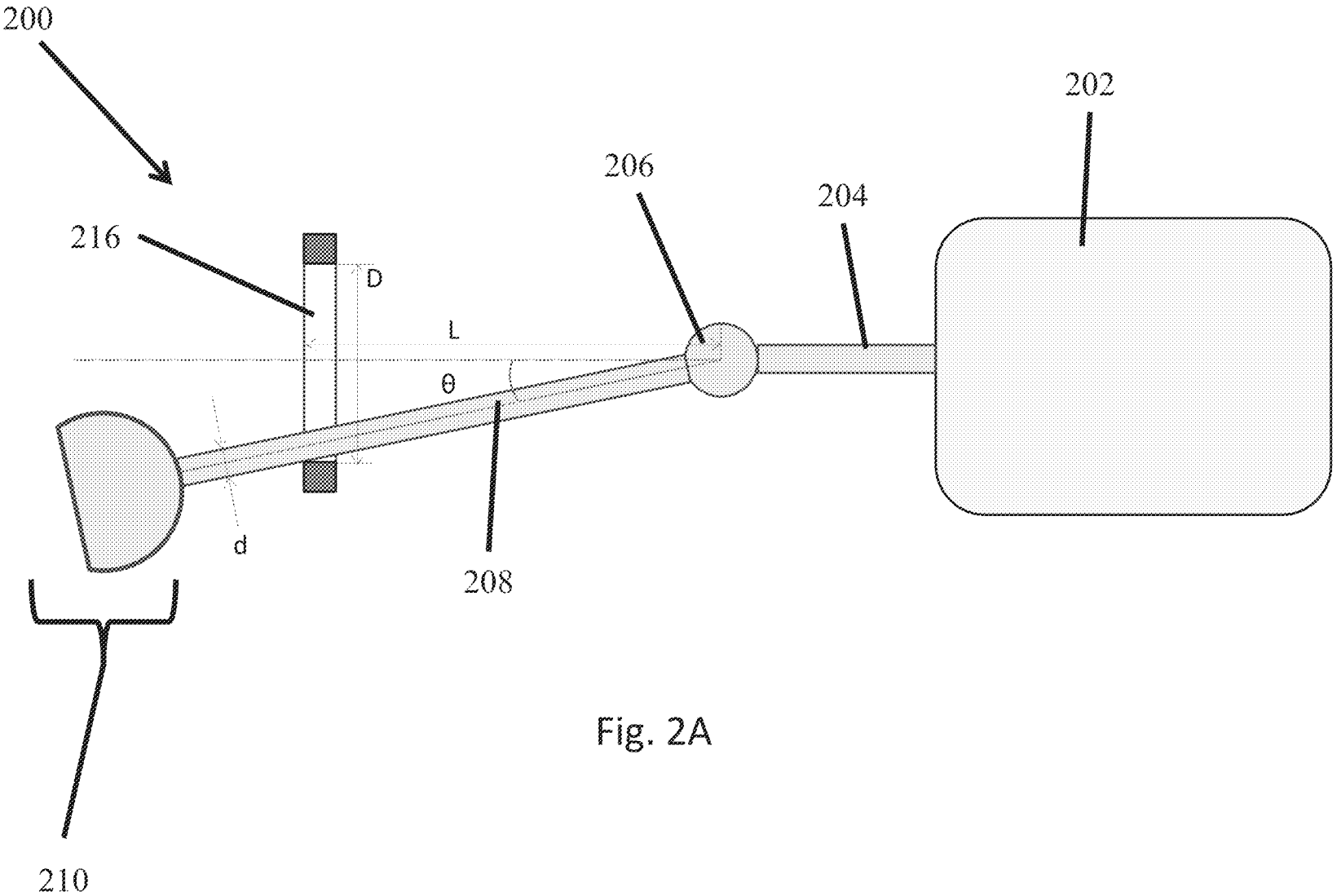
FIG. 2A is a diagram illustrating an example of a cleaning device having an alignment mechanism in accordance with at least one implementation of the present application.
Figure 2B:
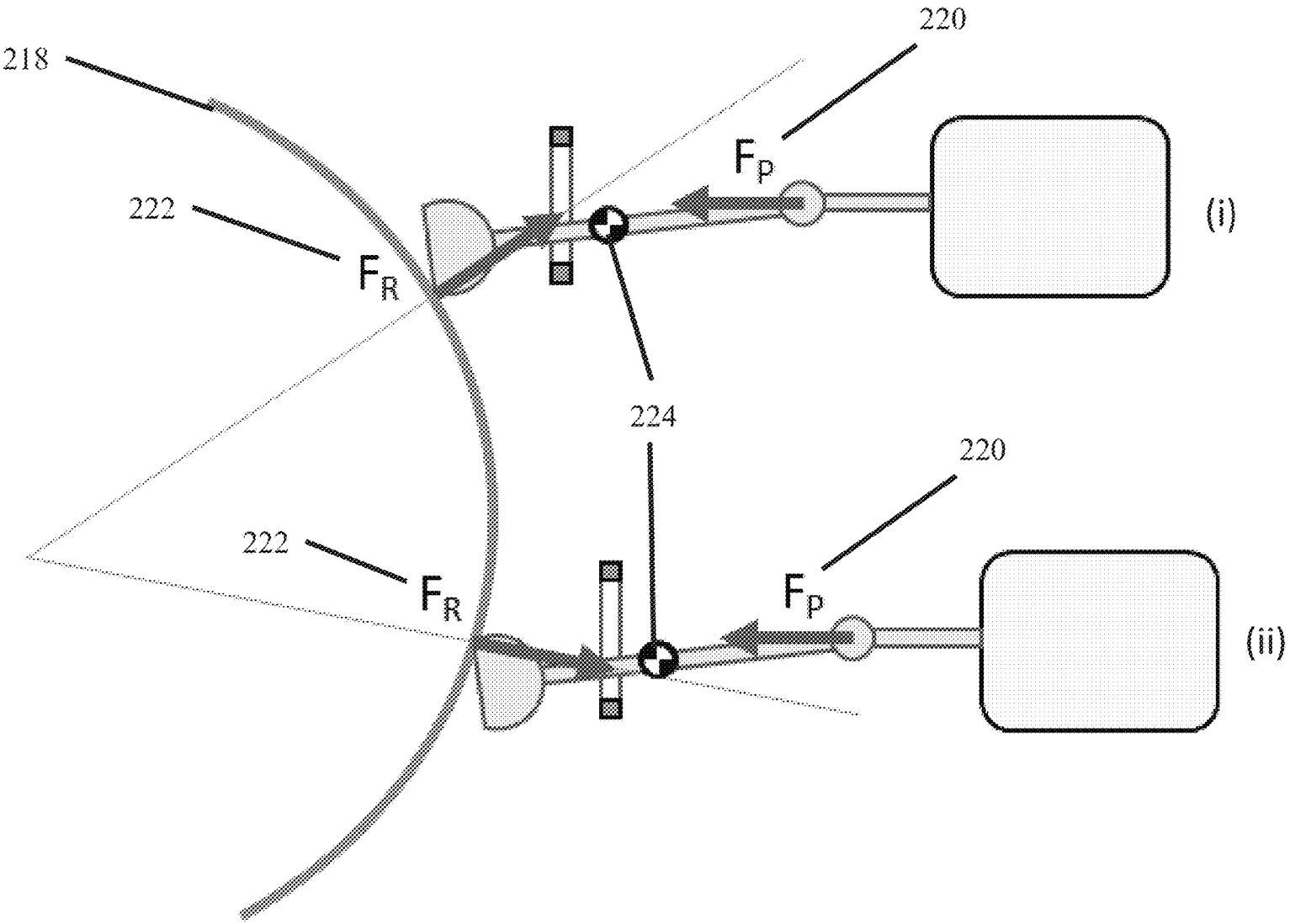
FIG. 2B is a diagram illustrating an example operation of a cleaning device having an alignment mechanism in accordance with at least one implementation of the present application.

Thus, in order to reduce the impact of traction and gravitational force effects, in accordance with a salient aspect of the invention, an alignment mechanism is provided. Referring now to FIGS. 2A-B, a cleaning device 200 is illustrated which includes a motor 202, a first shaft 204, a universal joint 206, a second shaft 208, and a cleaning mechanism 210 having a cleaning face. Together, these components interact and function substantially similar to the components found in the example implementation in FIG. 1, while providing the further feature of an alignment mechanism 216, introduced about the second shaft 208. For example, the alignment mechanism 216 can comprise a ring or a bearing that is coupled circumferentially around the second shaft 208. By introducing an alignment mechanism 216 to restrict the motion of the second shaft 208, the desired orientation of the cleaning mechanism 210 can be achieved while also resisting the gravitational forces pulling the cleaning mechanism downward.

In this example, the second shaft 208 has a diameter d, and the alignment mechanism 216 has a specified diameter D and is located a distance L from the universal joint 206. These parameters define the maximum allowable angle θ between the first shaft 204 and the second shaft 208, which in turn defines the angular range of the motion of the second shaft and cleaning mechanism 210. If the second shaft 208 is pointed toward the center of curvature at an angle less than the angle θ, then the alignment of the cleaning mechanism 210 can be corrected as the cleaning mechanism contacts a target surface. For example, as the cleaning face passes over a curved, non-uniform, or irregular target surface, the cleaning face receives forces that operate to change the angle between the first shaft 204 and second shaft 208. The angle so induced can only increase up to angle θ in accordance with this implementation of the invention. In particular, the angle θ can be selected by a user as one in which the cleaning mechanism 210 is still substantially effective at removing biofoul from a particular target surface. For example, a flatter target surface requires less adjustment of the cleaning mechanism 210 and, thus, a smaller angle θ can be chosen, whereas a highly irregular surface requires additional cleaning mechanism adjustment and thus a larger angle θ will be more effective. Determining the allowable deviation and choice of above mentioned geometrical parameters can be done empirically in accordance with the following equations:

$$\tan\theta = \frac{D - \frac{d}{\cos\theta}}{2L}$$

$$\theta = 2\tan^{-1}\frac{\sqrt{D^2 - d^2 + 4L^2} - 2L}{d + D}$$

In one or more implementations of the present application, the alignment mechanism 216 can include floatation objects designed to counter-balance gravitational effects.

With reference now to FIG. 2B, the interaction of cleaning device 200 with a curved surface 218 and the corresponding forces that act on the device during use is illustrated. A push force ($F_P$) 220 is provided to the cleaning device 200 along the direction indicated, which moves the device toward the curved surface 218. For example, the vehicle thrusters of a ROV can provide the $F_P$ 220 onto the cleaning device 200. When the cleaning mechanism 210 contacts the curved surface 218, a reaction force ($F_R$) 222 is generated along the direction indicated. Both $F_P$ 220 and $F_R$ 222 produce torques around the center of gravity 224 of the second shaft 208. The resultant moment from the combined torque produced by $F_P$ 220 and $F_R$ 222 can define whether or not the second shaft 208 rotates to align the cleaning mechanism 210 perpendicular to the curved surface 218.

As shown in illustration (i) of FIG. 2B, $F_P$ 220 causes a lower edge of the cleaning mechanism 210 to contact the curved surface 218. Upon contact, $F_P$ 220 creates a torque which urges the second shaft 208 to rotate in an angular direction that urges the cleaning mechanism 210 to point downwards. Simultaneously, $F_R$ 222 creates a torque which urges the second shaft 208 to rotate in an angular direction that urges the cleaning mechanism 210 to point upwards. If the torque produced by $F_P$ 220 is large enough to counteract the torque produced by $F_R$ 222, then the cleaning device 200 will work as expected, and the cleaning mechanism 210 will rotate to align the cleaning surface face of the cleaning mechanism to be perpendicular to the curved surface 218. For example, if $F_P$ 220 is greater than $F_R$ 222, the cleaning mechanism 210 can align to the curved surface.

However, as shown in illustration (ii) of FIG. 2B, if $F_P$ 220 causes an upper edge of the cleaning mechanism to contact the curved surface 218, then the cleaning device 200 would be unable to properly orient the cleaning mechanism 210 to the curved surface 218. This is because the torque created by $F_P$ 220 and $F_R$ 222 creates a resultant moment about the center of gravity 224 which urges the second shaft 208 in the same direction. The resultant moment points in a direction that would not align the cleaning mechanism perpendicular to the curved surface 218. Specifically, the cleaning mechanism 210 would rotate such that its surface face is turned away from the curved surface 218.

In either case, the choice of design parameters (e.g., θ, D, d, L and the length of the second shaft 208) can all affect how the torques created by $F_P$ 220 and $F_R$ 222 interact to create a resultant moment and in turn effect the cases in which the cleaning mechanism 210 works as intended. For example, by varying design parameters, the $F_P$ 220 necessary to counterbalance $F_R$ 222 to cause alignment can be increased or decreased. In one or more embodiments, additional alignment components can be introduced to aid in aligning the cleaning mechanism 210 surface face to the curved surface 218. For example, one or more magnets and/or one or more suction devices can be introduced at the cleaning device to further aid in cleaning mechanism 210 orientation. In particular, if the surface to be cleaned is ferromagnetic, introducing magnets at the cleaning surface face 112 of the cleaning mechanism 210 causes the surface to more easily orient when a $F_P$ 220 is applied.

Figure 3:
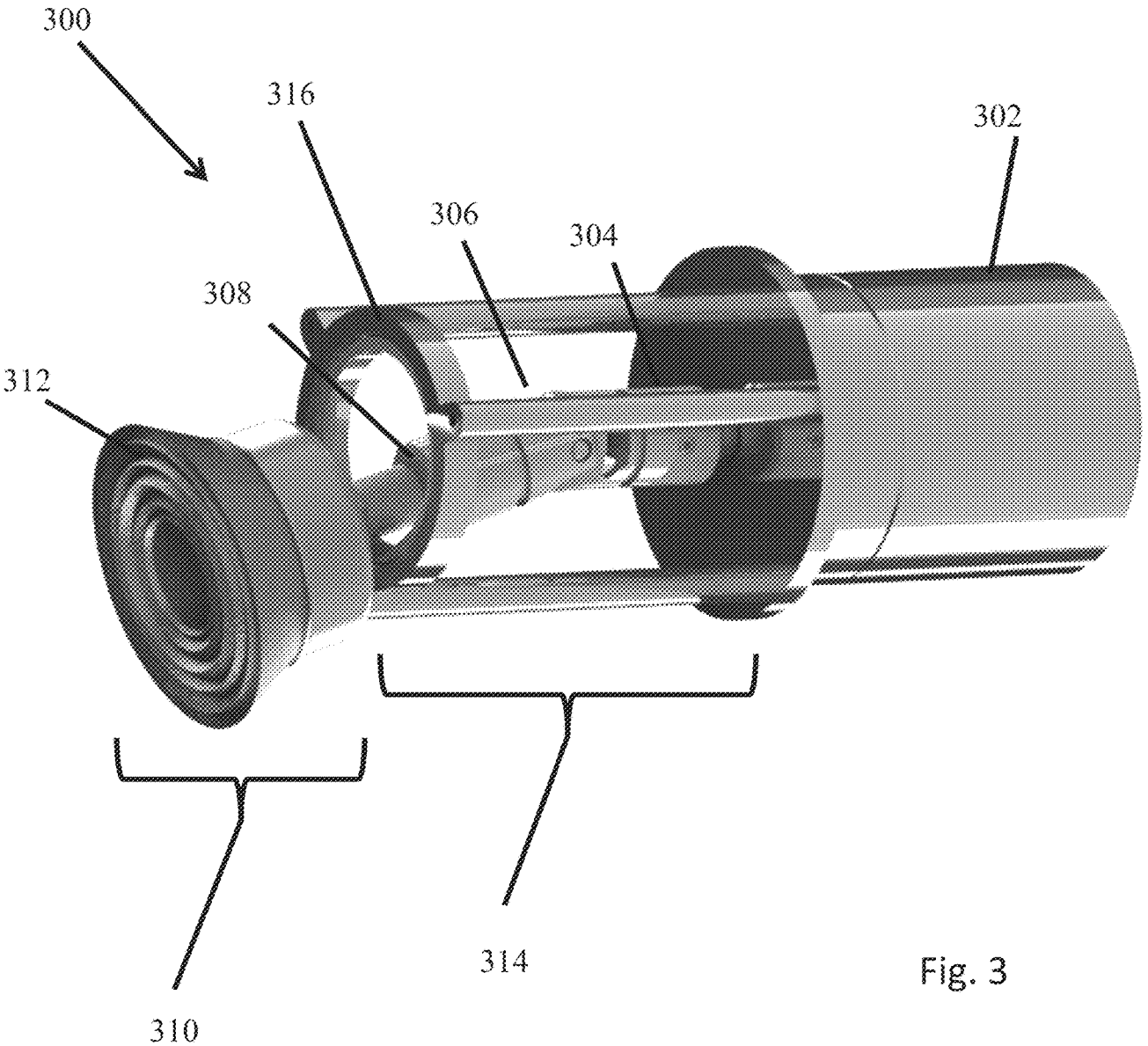
FIG. 3 illustrates an example cleaning device having an alignment mechanism including a bearing in accordance with at least one implementation of the present application.

Turning now to FIG. 3, an example cleaning device is illustrated in accordance with one or more implementations of the present application. A cleaning device 300 includes a motor 302 disposed in a housing, a first shaft 304, a universal joint 306, a second shaft 308, and a cleaning mechanism 310 having a cleaning face 312. In one or more implementations, an alignment mechanism 314 comprises a bearing 316 about the second shaft 308, such bearing being coupled to the housing surrounding the motor 302, thereby fixing the bearing in place about the longitudinal axis of the first shaft 304. In one or more implementations, the bearing 316 has a larger diameter than the second shaft 308 to provide free movement of the second shaft 308 through out a permitted range of θ within the inside diameter of the bearing 316. Depending on the curvature of the target surface, the diameter of the bearing 316 can be varied in optimize performance (e.g., smaller bearing diameters will restrict the angular motion range of the second shaft more than larger bearing diameters will). In one or more embodiments, the bearing 316 can include rollers disposed along the inner surface of the bearing for reducing friction created when the second shaft 308 rotates in contact with the bearing. For example, the rollers can be disposed along all or a portion of the inner circumference of the bearing. The rollers can be spherical, cylindrical, tapered, or comprise a combination of shaped rolling elements.

Figure 4A:
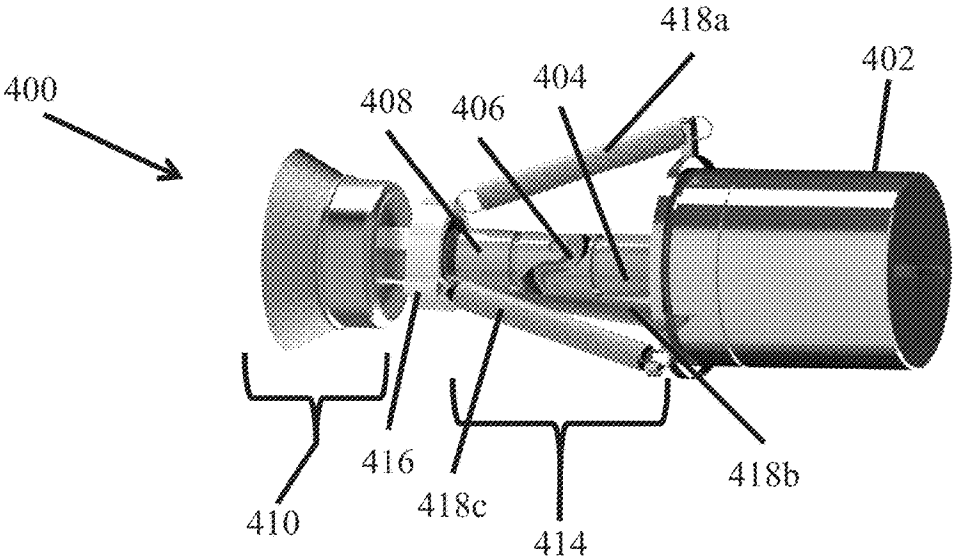
FIGS. 4A-B illustrate an example cleaning device having an alignment mechanism including a plurality of spring components in accordance with at least one implementation of the present application.
Figure 4B:
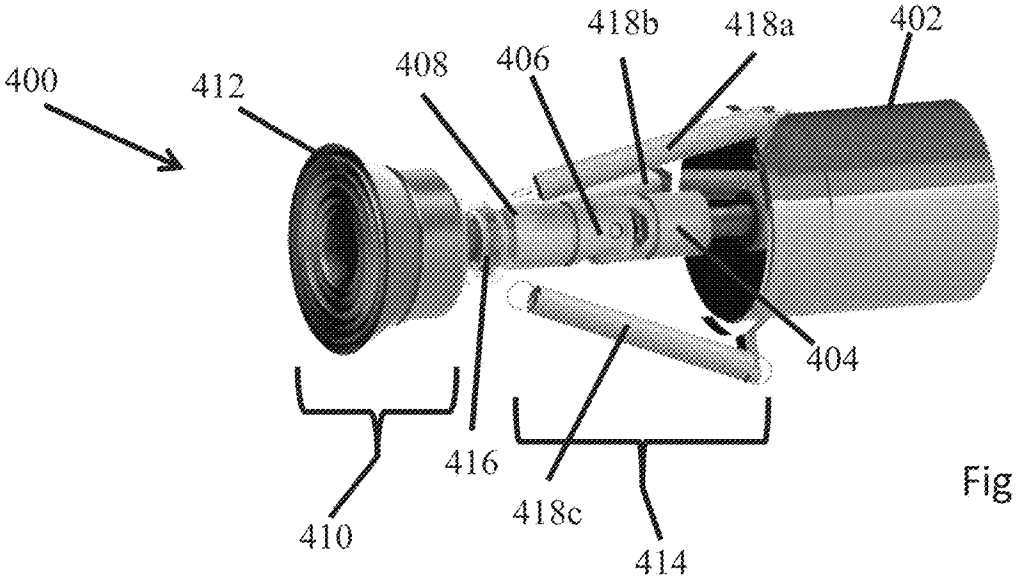

In one or more implementations of the present application, an arrangement of spring components can substitute for or supplement a bearing-type alignment mechanism. As shown in FIGS. 4A and 4B, a cleaning device 400 is provided, which includes a motor 402 disposed in a housing, a first shaft 404, a universal joint 406, a second shaft 408, and a cleaning mechanism 410 having a cleaning face 412. A proximal end of an alignment mechanism 414 is coupled to the housing of the motor 402, and a distal end of the alignment mechanism is coupled to a bearing 416. In one or more implementations, the bearing 416 has an inner diameter that matches the outer diameter of the second shaft 408. The bearing 416 is not directly coupled to the housing of the motor 402, but rather is suspended via one or more spring elements 418*a*, 418*b*, 418*c*, which hold the bearing in place while giving the cleaning mechanism 410 enough flexibility to align to a target surface. The range of motion of the cleaning mechanism 410 is restricted based on the stiffness of the spring elements 418 and location of the bearing 416 with respect to the universal joint 406. For example, as the stiffness of the spring elements 418 increases and as the bearing 416 is located nearer to the cleaning mechanism 410, the cleaning mechanism's range of motion is increasingly restricted.

In one or more implementations, the spring elements 418*a*, 418*b*, 418*c* are disposed about the first shaft 404 and second shaft 408. For example, the spring elements 418 can be disposed in a manner wherein each end of each spring element is coupled at a location spaced substantially equally from the location of the next spring element coupling. Locating the spring elements 418 substantially equally apart can provide the advantage of a more equal distribution of received traction forces, thereby aiding in maintaining a cleaning face 412 orientation substantially transverse to the target surface. For example, as shown in in FIGS. 4A-4B, the spring elements 418 can form a triangular pyramid shape. Other arrangements of one or more spring elements 418 can be implemented to achieve other desired specific cleaning mechanism 410 or cleaning face 412 orientations. Without loss of generality, the action of the spring elements can be accomplished by other mechanical elements such as pistons or dashpots.

Figure 5A:
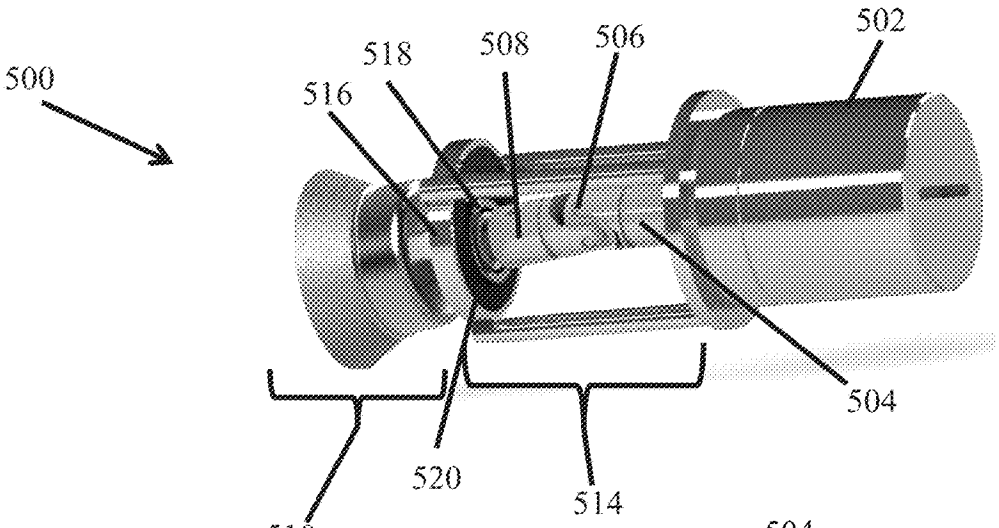
FIGS. 5A-B illustrate an example cleaning device having an alignment mechanism including a bearing having damping material in accordance with at least one implementation of the present application.
Figure 5B:
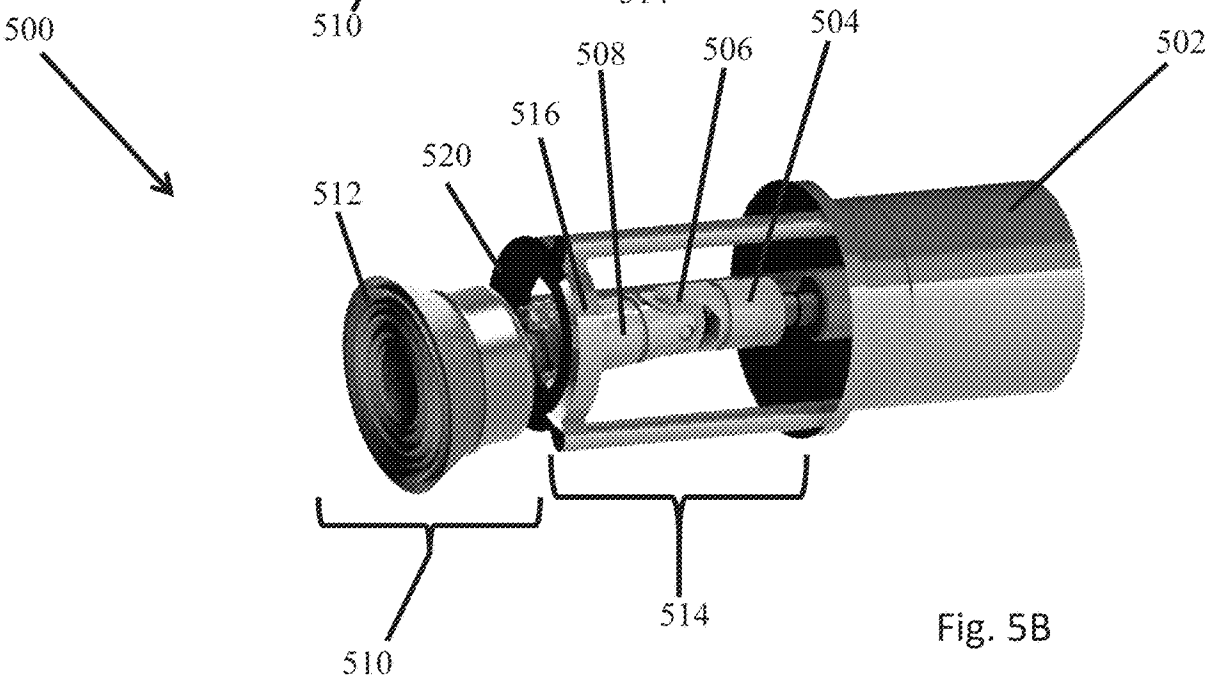

Referring now to FIGS. 5A and 5B, an example cleaning device is illustrated in accordance with one or more implementations of the present application. As illustrated, a cleaning device 500 includes a motor 502 disposed in a housing, a first shaft 504, a universal joint 506, a second shaft 508, and a cleaning mechanism 510 having a cleaning face 512. In one or more implementations, the cleaning device 500 includes an alignment mechanism 514 having an outer bearing 516 and an inner bearing 518 about the second shaft 506, such outer bearing being coupled to the housing surrounding the motor 502, thereby fixing the outer bearing in place about the longitudinal axis of the first shaft 504. The diameter of the inner bearing 518 can, for example, match the outer diameter of the second shaft 508. Additionally, a dampening material 520 is disposed between the outer bearing 516 and the inner bearing 518. The dampening material 520 is flexible and as traction and gravitational forces act upon the cleaning device 500, the dampening material compresses to resist disorienting the cleaning mechanism 510 away from the target surface. For example, the dampening material 520 can be rubber or other flexible materials.

Figure 6:
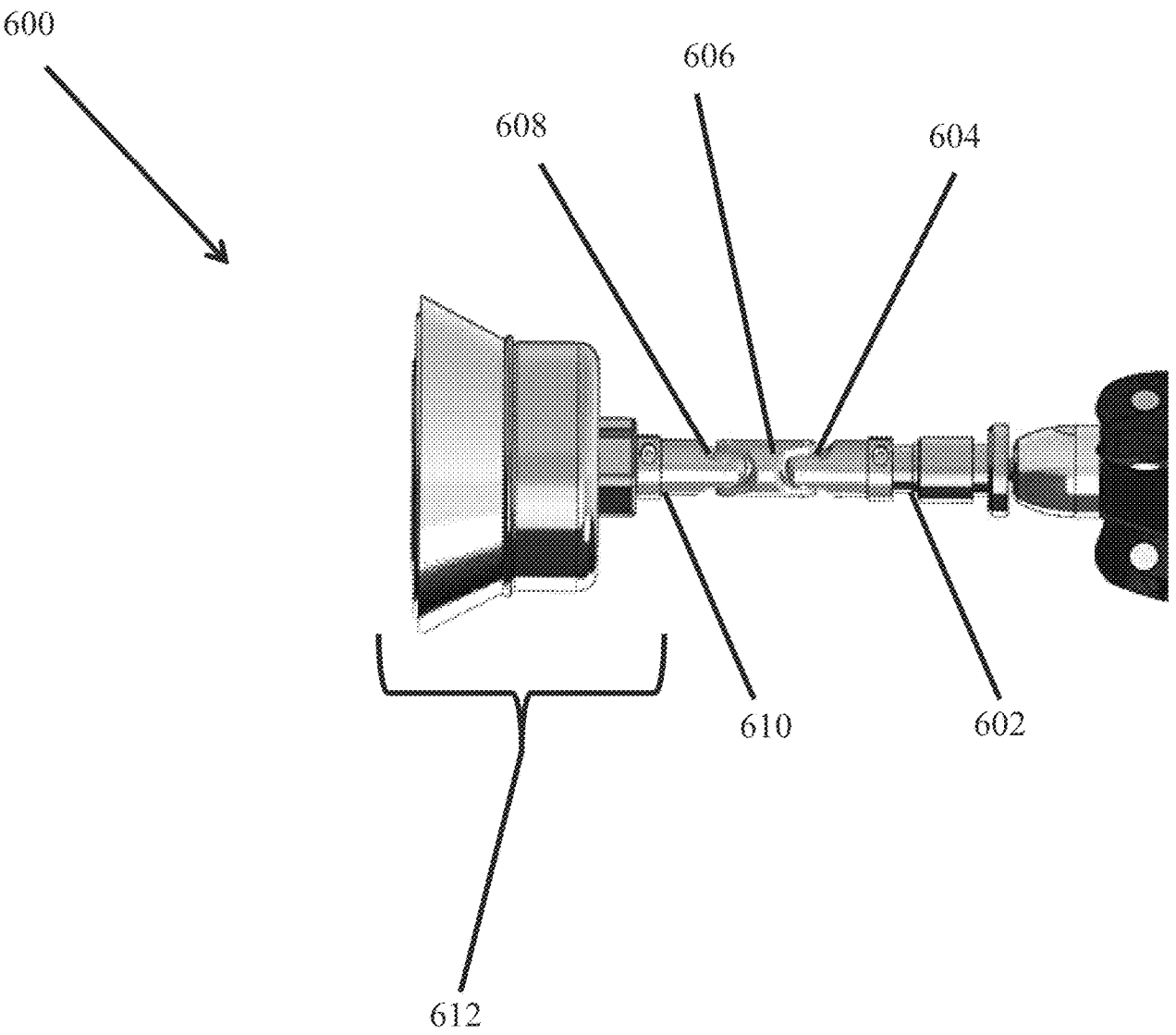
FIG. 6 illustrates an example cleaning device having a plurality of universal joints in accordance with at least one implementation of the present application.

FIG. 6 illustrates an example cleaning device 600 having a plurality of universal joints in accordance with one or more implementations of the present application. The cleaning device 600 includes a motor (not shown, but which can be as previously described), a first shaft 602, a first universal joint 604, a linking component 606, a second universal joint 608, a second shaft 610, and a cleaning mechanism 610. In this implementation, the motor, first shaft 602, and first universal joint 604 are coupled in the same way as described above. Additionally, the first universal joint 604 is coupled to a proximal end of the linking component 606 and the second universal joint 608 is coupled to a distal end of the linking component. The second universal joint 608 is then coupled to a proximal end of the second shaft as in other implementations discussed herein. The introduction of a second universal joint provides additional degrees of freedom of movement to the cleaning device 600, which contribute additional cleaning mechanism 610 maneuverability when orienting to a target surface. Further, in one or more implementations, an alignment mechanism (e.g., alignment mechanism 314, 414, 514) can be introduced to further limit traction and gravitational forces.

In one or more implementations, a dual concentric brush system is provided in order to minimize the net traction force and enhance cleaning device stability and cleaning quality. Two sets of brushes are disposed concentrically on a cleaning face (e.g., cleaning face 112, 312, 412, etc.), in which each set rotates in a circular motion in a direction opposite to the other set. The addition of a smaller set of rotating brushes within a larger circumference of brushes creates an opposing traction force to lessen the traction force generated by the larger set of brushes. This dual brush system can be provided, for example, by a planetary gear system. In one or more implementations, a planetary gear set includes a sun gear, one or more planetary gears meshed with the sun gear, a ring gear meshed with the planetary gears, and a carrier coupled to the planetary gears. The larger in circumference first brush set can be coupled to the ring gear and the smaller second brush set can be coupled to the sun gear. As understood in the art, by coupling the respective brushes to an even or odd number of gears off of the sun gear, the respective brushes can be driven in a clockwise or counterclockwise manner.

In one or more implementations, a linear motion can be introduced by a motor or by an ROV to move the cleaning mechanism or entire cleaning device in a linear forward and back motion during cleaning. Such oscillating motion avoids stalling the cleaning mechanism and embedding it into in biofoul. Avoiding prolonged embedment in the biofoul assists in maintaining a high rotational speed of the brushes or other cleaning instruments of the cleaning mechanism. The linear motion can be provided, for example, by a crank mechanism coupled to the motor so as to convert rotary motion into linear motion. In one or more implementations, a scraping tool can be implemented as a part of the cleaning mechanism that takes advantage of such linear motion to provide additional cleaning or scrubbing power.

Notably, the figures and examples above are not meant to limit the scope of the present application to a single implementation, as other implementations are possible by way of interchange of some or all of the described or illustrated elements. Moreover, where certain elements of the present application can be partially or fully implemented using known components, only those portions of such known components that are necessary for an understanding of the present application are described, and detailed descriptions of other portions of such known components are omitted so as not to obscure the application. In the present specification, an implementation showing a singular component should not necessarily be limited to other implementations including a plurality of the same component, and vice-versa, unless explicitly stated otherwise herein. Moreover, applicants do not intend for any term in the specification or claims to be ascribed an uncommon or special meaning unless explicitly set forth as such. Further, the present application encompasses present and future known equivalents to the known components referred to herein by way of illustration.

The foregoing description of the specific implementations will so fully reveal the general nature of the application that others can, by applying knowledge within the skill of the relevant art(s) (including the contents of the documents cited and incorporated by reference herein), readily modify and/or adapt for various applications such specific implementations, without undue experimentation, without departing from the general concept of the present application. Such adaptations and modifications are therefore intended to be within the meaning and range of equivalents of the disclosed implementations, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various implementations of the present application have been described above, it should be understood that they have been presented by way of example, and not limitation. It would be apparent to one skilled in the relevant art(s) that various changes in form and detail could be made therein without departing from the spirit and scope of the application. Thus, the present application should not be limited by any of the above-described example implementations

What is claimed:

1. A device for cleaning an underwater surface of an object, comprising:

a motor housing;

a motor for providing power disposed within the motor housing;

a first shaft having a proximal end coupled to the motor and a distal end, wherein the first shaft extends longitudinally from the motor along a first axis, and wherein the motor provides power to the first shaft to enable the first shaft to rotate around the first axis;

a universal joint coupled to the distal end of the first shaft;

a second shaft having a proximal end coupled to the universal joint and a distal end, wherein the second shaft extends longitudinally away from the universal joint along a second axis, wherein the universal joint transfers the power of the motor to the second shaft to enable the second shaft to rotate around the second axis, and wherein the second shaft has one or more degrees of freedom of movement;

a cleaning mechanism coupled to the distal end of the second shaft and including a cleaning face disposed in a plane substantially perpendicular to the second axis; and an alignment mechanism disposed about the second shaft and coupled to the motor housing, in which the alignment mechanism includes an outer bearing aligned about the first axis and an inner bearing aligned about the second shaft that are shaped and sized to restrict movement of the second shaft to within a prescribed maximum angle relative to the first shaft, and wherein the cleaning mechanism is oriented by the alignment mechanism substantially perpendicular to the surface of the object throughout any cleaning of the underwater surface.

2. A device according to claim 1, wherein the cleaning mechanism comprises one or more rotatable brushes disposed on the cleaning face.

3. A device according to claim 1, wherein the cleaning mechanism contacts the underwater surface at two substantially diametrically opposed points.

4. A device according to claim 1, wherein the cleaning mechanism passively contours to the outer surface of the object.

5. A device according to claim 1, wherein the second shaft transfers the power of the motor to the cleaning mechanism to enable the cleaning mechanism to rotate around the second axis.

6. A device according to claim 1, wherein the device is mounted on a remotely operated underwater vehicle.

7. A device according to claim 1, wherein the cleaning mechanism includes an adhesion component having one or more rare earth magnets, electromagnets, or suction mechanisms.

8. A device according to claim 1, wherein the alignment mechanism is coupled circumferentially around the second shaft.

9. A device according to claim 1, wherein a dampening material is disposed between the outer bearing and the inner bearing.

10. The device of claim 9, wherein the dampening material comprises rubber.

11. A device according to claim 1, wherein the cleaning mechanism includes a planetary gear set having a sun gear, one or more planetary gears meshed with the sun gear, a ring gear meshed with the planetary gears, and a carrier coupled to the planetary gears.

12. A device according to claim 11, further comprising a first brush, and a second brush, and wherein the first brush and second brush are concentric with one another and the first brush is coupled to the ring gear and the second brush is coupled to the sun gear.

13. A device for cleaning an underwater surface of an object, comprising:

a motor housing;

a motor for providing power disposed within the motor housing;

a first shaft having a proximal end coupled to the motor and a distal end, wherein the first shaft extends longitudinally from the motor along a first axis, and wherein the motor provides power to the first shaft to enable the first shaft to rotate around the first axis;

a first universal joint coupled to the distal end of the first shaft;

a linking component having a proximal end coupled to the first universal joint and a distal end, wherein the linking component extends longitudinally away from the first universal joint along a second axis, wherein the first universal joint transfers the power of the motor to the linking component to enable the linking component to rotate around the second axis, and wherein the linking component has one or more degrees of freedom of movement;

a second universal joint coupled to the distal end of the linking component, a second shaft having a proximal end coupled to the second universal joint and a distal end, wherein the second shaft extends longitudinally away from the second universal joint along a third axis, wherein the second universal joint transfers the power of the motor to the second shaft to enable the second shaft to rotate around the third axis, and wherein the second shaft has one or more degrees of freedom of movement;

an alignment mechanism disposed about the second shaft and coupled to the motor housing to provide free angular movement of the second shaft along a prescribed range of motion; and a cleaning mechanism coupled to the distal end of the second shaft and including a cleaning face disposed in a plane substantially perpendicular to the third axis.

14. A device according to claim 13, wherein the alignment mechanism is shaped and sized to restrict movement of the second shaft to within a prescribed maximum angle relative to the first shaft, and wherein the cleaning mechanism is oriented by the alignment mechanism substantially perpendicular to the surface of the object throughout any cleaning of the underwater surface.

15. A device according to claim 14, wherein the alignment mechanism is coupled circumferentially around the second shaft.

16. A device according to claim 14, wherein the alignment mechanism comprises one or more of the following: bearings, spring components, and bearings having dampening material.

17. A device for cleaning an underwater surface of an object, comprising:

a motor housing;

a motor for providing power disposed within the motor housing;

a first shaft having a proximal end coupled to the motor and a distal end, wherein the first shaft extends longitudinally from the motor along a first axis, and wherein the motor provides power to the first shaft to enable the first shaft to rotate around the first axis;

a universal joint coupled to the distal end of the first shaft;

a second shaft having a proximal end coupled to the universal joint and a distal end, wherein the second shaft extends longitudinally away from the universal joint along a second axis, wherein the universal joint transfers the power of the motor to the second shaft to enable the second shaft to rotate around the second axis, and wherein the second shaft has one or more degrees of freedom of movement;

a cleaning mechanism coupled to the distal end of the second shaft and including a cleaning face disposed in a plane substantially perpendicular to the second axis; and an alignment mechanism disposed about the second shaft and coupled to the motor housing by one or more spring components, and wherein the cleaning mechanism is oriented by the alignment mechanism substantially perpendicular to the surface of the object throughout any cleaning of the underwater surface.

18. The device of claim 17, wherein the one or more spring components comprise three or more spring components that are spaced substantially equally apart.

* * * * *